US007346952B2

(12) United States Patent
Becker

(10) Patent No.: US 7,346,952 B2
(45) Date of Patent: Mar. 25, 2008

(54) METHOD FOR DYEING GARMENTS AND TEXTILE LINE THEREFOR

(75) Inventor: Hubert Becker, Aachen-Brand (DE)

(73) Assignee: Helga Becker, Aachen-Brand (DE)

( * ) Notice: Subject to any disclaimer, the term of this patent is extended or adjusted under 35 U.S.C. 154(b) by 600 days.

(21) Appl. No.: 10/492,793

(22) PCT Filed: Sep. 7, 2002

(86) PCT No.: PCT/EP02/10028

§ 371 (c)(1),
(2), (4) Date: Apr. 16, 2004

(87) PCT Pub. No.: WO03/035969

PCT Pub. Date: May 1, 2003

(65) Prior Publication Data

US 2005/0028304 A1 Feb. 10, 2005

(30) Foreign Application Priority Data

Oct. 16, 2001 (DE) ..... 101 50 465

(51) Int. Cl.
*D06B 3/30* (2006.01)

(52) U.S. Cl. ..... 8/151; 8/150

(58) Field of Classification Search ..... 8/151–155.2, 8/150

See application file for complete search history.

(56) References Cited

U.S. PATENT DOCUMENTS 3,762,866 A * 10/1973 Rayment et al. ..... 8/149.1
3,985,003 A * 10/1976 Reed ..... 66/196
4,005,500 A * 2/1977 Rayment ..... 8/149.1
5,840,084 A * 11/1998 Bella et al. ..... 8/549
6,327,711 B1 * 12/2001 Fujiwara ..... 2/69
6,401,498 B1 * 6/2002 Fujiwara ..... 66/195

FOREIGN PATENT DOCUMENTS

| | | |
|---|---|---|
| DE | 2 238 765 | 2/1974 |
| DE | 25 39 037 | 3/1977 |
| DE | 33 03 526 A1 | 7/1984 |
| EP | 0 122 835 | 10/1984 |
| EP | 0 354 086 | 2/1990 |
| EP | 0 374 477 | 6/1990 |
| EP | 0 441 080 | 8/1991 |
| FR | 2 603 914 | 7/1988 |
| GB | 2 023 680 | 1/1980 |
| WO | WO 03/035969 | 5/2003 |

OTHER PUBLICATIONS

Electronic translation of FR 2603914 to Barriquand et al., Mar. 18, 1988.*
Official translation of FR 2603914.*

* cited by examiner

*Primary Examiner*—Joseph L. Perrin
(74) *Attorney, Agent, or Firm*—Berenato, White & Stavish

(57) ABSTRACT

The disclosure describes a method for dyeing garments in a dyeing machine using a dyeing bath. The garments are previously connected to one another to form a line, and the line is moved through the dyeing bath. The disclosure also concerns a textile line for use in a dyeing machine, in which the line comprises garments connected to one another.

9 Claims, No Drawings

METHOD FOR DYEING GARMENTS AND TEXTILE LINE THEREFOR

The invention concerns a method for dyeing garments in a dyeing machine by means of a dyeing bath. The invention further concerns a textile line for carrying out this method.

Two fundamental procedures are known for imparting a specific color to a garment. In the first procedure, a material web is produced from color-dyed threads, or a material web is first produced from white, undyed threads and is then dyed the desired color. The colored material web is then fabricated into a garment. Dyeing is generally performed by the manufacturer of the material webs, and dyeing of the material web can occur in various ways. It is usual to perform dyeing in a line dyeing machine. For this, a material web is formed into an endless line between 10 and 500 m long that is pulled through a dyeing bath in circulating fashion within the line dyeing machine for a period of one-half to one hour. The temperature is usually approximately 98° C., but in high-temperature machines it can go as high as 130° C. Instead of being a single material web, the line can also be assembled by sewing together individual material web pieces (cf. DE 22 38 765 A).

The advantages of this dyeing method are that consistent and gentle and reproducible dyeing is obtained. It is disadvantageous, however, that even before fabrication, customers must decide in terms of colors and must lay in corresponding stocks. The customers thus can react only in delayed fashion to color trends.

A second procedure has thus become established more recently. In this procedure, it is not the material webs before fabrication that are dyed, but only the completed garments. Dyeing is performed in drum dyeing machines similar to large washing machines. Up to 300 kg of garments can be introduced into such machines for one dyeing operation.

The advantage of this procedure is that dyeing is performed much later and thus closer to the time of sale, and it is thus possible to react more quickly to new color trends. This must be set off, however, against the fact that the dyeing quality and reproducibility attained with the first procedure by dyeing material webs is not achieved. In addition, dyeing in drum dyeing machines can be performed only at 98° C. Garments made of materials that require a higher dyeing temperature are therefore excluded from this procedure. In addition, facilities that dye completed garments in drum dyeing machines generally do not have the experience to perform subsequent textile finishing. The reason for this is that they do not know what treatment the manufacturer of the undyed material webs has already carried out. This knowledge is particularly important in terms of coordinating the chemistry and the individual working steps with one another. Final setting, appret, and finishing are thereby optimally matched.

It is thus the object of the invention to make available a dyeing method with which on the one hand color trends can be quickly reacted to, but which on the other hand ensures consistent, gentle, and reproducible dyeing.

According to the present invention, this object is achieved in that the completed garments are connected to one another into a line before dyeing, and the line is moved through the dyeing bath. The garments should preferably be connected into an endless line which is then moved in circulating fashion through the dyeing bath, this usefully occurring in a line dyeing machine as commonly used for the dyeing of material webs.

The basic idea of the invention is thus to constitute a line from a plurality of fabricated garments, and then to dye that line like a line constituted from a material web. The advantages of dyeing completed garments are thus combined in particularly advantageous fashion with the advantages of dyeing material webs. Since dyeing occurs only after production of the garments, it is possible to react flexibly to new color trends. The fabricator need not stock a large number of differently dyed materials, i.e. his inventory is reduced. In contrast to dyeing by means of drum dyeing machines, the quality of the dyeing with the method according to the present invention is comparable to the line dyeing of material webs, i.e. it is consistent and gentle and reproducible. At least with larger loads, substantially faster production is possible. In addition, the method according to the present invention is more flexibly applicable, since line machines can be operated even at higher temperatures of up to 130° C.

Dyeing can furthermore be performed in conventional dyeing facilities, which usually can also perform all the additional textile finishing method steps in the same facility so that transport to other facilities can be eliminated. The method is thus, despite its proximity to the market, more cost-effective than the known method.

In principle, no limitations exist as to how the individual garments are connected to one another. It is advantageous, however, if they are connected to one another in the direction of their greatest longitudinal extension, i.e., for example in the case of trousers, the open ends of the trouser legs and the waistband, and in the case of skirts the hem and the waistband. Advantageously, the garments should in each case be connected to one another in mirror-image fashion, i.e. for trousers, two pairs are connected to one another either at their waistbands or at the open ends of their legs, and so on alternatingly.

There are also essentially no limitations in terms of the manner in which the garments are connected to one another. For example, the garments can be temporarily sewn to one another; the sewing can also be limited to specific regions so that openings remain into the interior of the garments. Instead of or in combination with temporary sewing, respectively opposite loops can also be temporarily sewn onto the garments, if such loops are not already present as belt loops. The loops are then connected to one another, for example, by being tied with plastic cords.

To allow the line made up of the garments to be used in existing line dyeing machines, it should have a length of at least 10 m, preferably between 300 and 500 m.

The subject matter of the invention is furthermore a textile line for use in a dyeing machine, in particular a line dyeing machine. According to the present invention, the line comprises garments connected to one another that preferably form an endless line. The garments can be connected in the manner already described above.

The invention claimed is:

1. A method for dyeing garments in a dyeing machine by means of a dyeing bath, wherein the garments are previously connected to one another to form a line, and the line is moved through the dyeing bath, wherein the step of connecting the garments to one another to form the line comprises connecting articles of clothing to one another to form the line, the articles of clothing being selected from a group consisting of: skirts and trousers.

2. The method as defined in claim 1 wherein the garments are connected into an endless line, and the line is moved in circulating fashion through the dyeing bath.

3. The method as defined in claim 2, wherein the line is dyed in a line dyeing machine.

4. The method as defined in any of claim 1 wherein the garments are respectively connected to one another in mirror-image fashion.

5. The method as defined in claim 1, wherein the garments are temporarily sewn to one another.

6. The method as defined in claim 1, wherein respectively opposite loops are temporarily sewn onto the garments, and the loops are connected to one another.

7. The method as defined in claim 6, wherein the loops are tied to one another.

8. The method as defined in claim 1, wherein the garments are connected into a line having a length of at least 10 m.

9. A method for dyeing garments, the method comprising the steps of:

connecting a plurality of articles of clothing together into a line; and pulling the line of connected articles of clothing through a stationary dye baths, wherein the articles of clothing to be connected are selected from a group consisting of: trousers and skirts.

* * * * *